US011306377B2

(12) United States Patent
Zhang et al.

(10) Patent No.: US 11,306,377 B2
(45) Date of Patent: Apr. 19, 2022

(54) HIGH STRENGTH, HIGH TOUGHNESS, HEAT-CRACKING RESISTANT BAINITE STEEL WHEEL FOR RAIL TRANSPORTATION AND MANUFACTURING METHOD THEREOF

(71) Applicants: NMAGANG (GROUP) HOLDING CO., LTD., Maanshan (CN); MAANSHAN IRON & STEEL CO., LTD., Maanshan (CN)

(72) Inventors: Mingru Zhang, Maanshan (CN); Zheng Fang, Maanshan (CN); Feng Zhang, Maanshan (CN); Chaohai Yin, Maanshan (CN); Yumei Pu, Maanshan (CN); Zhiyuan Cheng, Maanshan (CN); Hai Zhao, Maanshan (CN)

(73) Assignees: MAGANG (GROUP) HOLDING CO., LTD., Maanshan (CN); MAANSHAN IRON & STEEL CO., LTD., Maanshan (CN)

( * ) Notice: Subject to any disclaimer, the term of this patent is extended or adjusted under 35 U.S.C. 154(b) by 156 days.

(21) Appl. No.: 16/314,396

(22) PCT Filed: Jul. 6, 2017

(86) PCT No.: PCT/CN2017/091927
§ 371 (c)(1),
(2) Date: Dec. 29, 2018

(87) PCT Pub. No.: WO2018/006844
PCT Pub. Date: Jan. 11, 2018

(65) Prior Publication Data

US 2019/0323109 A1 Oct. 24, 2019

(30) Foreign Application Priority Data

Jul. 6, 2016 (CN) ..... 201610527577.7

(51) Int. Cl.
*C22C 38/16* (2006.01)
*C21D 9/34* (2006.01)
(Continued)

(52) U.S. Cl.
CPC ..... *C22C 38/16* (2013.01); *C21D 1/18* (2013.01); *C21D 9/0062* (2013.01); *C21D 9/34* (2013.01);
(Continued)

(58) Field of Classification Search
None
See application file for complete search history.

(56) References Cited

U.S. PATENT DOCUMENTS 5,382,307 A * 1/1995 Kageyama et al. ..... C21D 9/04 148/584
6,190,469 B1 * 2/2001 Koh et al. ..... C22C 38/16 148/500
(Continued)

FOREIGN PATENT DOCUMENTS

CN 1207143 A 2/1999
CN 101220441 A 7/2008
(Continued)

OTHER PUBLICATIONS

English translation of JP 2002-129285-A (originally published May 2002) from Espacenet.*

*Primary Examiner* — George Wyszomierski
(74) *Attorney, Agent, or Firm* — Zhihua Han; Wen IP LLC

(57) ABSTRACT

The present invention provides a high strength, high toughness, heat-cracking resistant bainite steel wheel for rail transportation and a manufacturing method thereof. Components are: carbon 0.10-0.40%, silicon 1.00-2.00%, manganese 1.00-2.50%, copper 0.20-1.00%, boron 0.0001-
(Continued)

0.035%, nickel 0.10-1.00%, phosphorus ≤0.020%, and sulphur ≤0.020%, where the remaining is iron and unavoidable residual elements, 1.50%≤Si+Ni≤3.00%, and 1.50%≤Mn+Ni+Cu≤3.00%. Compared with the prior art, in the present invention, by using design of the chemical compositions of steel and wheel manufacturing processes, especially a heat treatment process and technology, a rim of the wheel obtains a carbide-free bainite structure, and a web and a wheel hub obtain a metallographic structure based on granular bainite and a supersaturated ferritic structure. The wheel has comprehensive mechanical properties such as high strength, high toughness, heat-cracking resistant performance and good service performance, thereby improving a service life and comprehensive efficiency of the wheel, bringing specific economic and social benefits.

5 Claims, 6 Drawing Sheets

(51) Int. Cl.

| | |
|---|---|
| ***C21D 1/18*** | (2006.01) |
| ***C21D 9/00*** | (2006.01) |
| ***C22C 38/02*** | (2006.01) |
| ***C22C 38/04*** | (2006.01) |
| ***C22C 38/08*** | (2006.01) |

(52) U.S. Cl.

CPC ..... *C22C 38/02* (2013.01); *C22C 38/04* (2013.01); *C22C 38/08* (2013.01); *C21D 2211/001* (2013.01); *C21D 2211/002* (2013.01); *C21D 2211/005* (2013.01); *C22C 2202/00* (2013.01)

(56) References Cited

U.S. PATENT DOCUMENTS

| | | | | |
|---|---|---|---|---|
| 2011/0030857 | A1* | 2/2011 | Kwak | C21D 9/46 148/645 |
| 2014/0144557 | A1* | 5/2014 | Zhang | C21D 8/0263 148/547 |
| 2014/0242416 | A1* | 8/2014 | Matsuda | C22C 38/08 428/659 |
| 2019/0093190 | A1* | 3/2019 | Shiimori | C23C 2/02 |

FOREIGN PATENT DOCUMENTS

| | | | |
|---|---|---|---|
| CN | 102199722 | A | 9/2011 |
| CN | 106191665 | A | 7/2016 |
| JP | 2002129285 | A | 5/2002 |

* cited by examiner

Bainite wheel CL60 wheel

HIGH STRENGTH, HIGH TOUGHNESS, HEAT-CRACKING RESISTANT BAINITE STEEL WHEEL FOR RAIL TRANSPORTATION AND MANUFACTURING METHOD THEREOF

CROSS REFERENCE TO RELATED APPLICATION

This application is a national stage application of International application number PCT/CN2017/091927, filed Jul. 6, 2017, titled "HIGH STRENGTH, HIGH TOUGHNESS, HEAT-CRACKING RESISTANT BAINITE STEEL WHEEL FOR RAIL TRANSPORTATION AND MANUFACTURING METHOD THEREOF," which claims the priority benefit of Chinese Patent Application No. 2016105275777, filed on Jul. 6, 2016, which is hereby incorporated by reference in its entirety.

TECHNICAL FIELD

The present invention belongs to the field of design of chemical compositions of steel and wheel manufacturing, and specifically, to a high strength, high toughness, heat-cracking resistant bainite steel wheel for rail transportation and manufacturing method thereof, and steel design of other elements and similar elements in rail transportation and a production and manufacturing method thereof.

BACKGROUND

"High speed, heavy load, and low noise" are a main development direction of world rail traffic. Wheels are "shoes" of the rail traffic, which are one of most important runner elements and directly affect traveling safety. In a normal train traveling process, wheels bear a full load weight of a vehicle, and are subject to wear and rolling contact fatigue (RCF) damage. In addition, more importantly, wheels have a very complex interaction relationship with steel rails, brake shoes, axletrees, and surrounding media, and are in a dynamic alternating stress state. Especially, the wheels and the steel rails, and the wheels and the brake shoes (except for disc brakes) are two pairs of friction couples that always exist and cannot be ignored. In an emergency or during running on a special road, brakes are subject to significant thermal damage and friction damage. In addition, thermal fatigue is generated, also affecting wheel safety and a service life.

In rail traffic, when wheels satisfy basic strength, particular attention is paid to a roughness indicator of the wheels to ensure safety and reliability. Freight transport wheels are seriously worn and have serious rolling contact fatigue (RCF) damage. In addition, tread braking is used for the wheels, which causes serious thermal fatigue damage, leading to defects such as peeling, flaking, and rim cracking.

More attention is paid to toughness and low-temperature toughness of passenger transport wheels. Because disc brakes are used in passenger transport, thermal fatigue during braking is reduced.

Currently, national and international wheel steel for rail traffic, for example, Chinese wheel standards GB/T8601 and TB/T2817, European wheel standard EN13262, Japanese wheel standard JRS and JIS B5402, and North American wheel standard AAR M107, uses medium-to-high carbon steel or medium-to-high carbon microalloyed steel, where microstructures of both are of a pearlite-ferritic structure. CL60 wheel steel is rolled wheel steel mainly used in Chinese current rail traffic vehicles (for passenger and freight transport), and BZ-L wheel steel is cast wheel steel mainly used in Chinese current rail traffic vehicles (for freight transport), where microstructures of both are of a pearlite-ferritic structure.

For a schematic diagram of names of wheel elements, refer to FIG. 1, and for main technical indicators of CL60 steel, refer to Table 1.

TABLE 1

Main technical requirements for CL60 wheel Steels

| | Component, wt % | | | Rim performance requirement | | | |
|---|---|---|---|---|---|---|---|
| Material | C | Si | Mn | $R_m$, MPa | A % | Z % | Hardness, HB |
| CL60 | 0.55-0.65 | 0.17-0.37 | 0.50-0.80 | >910 | >10 | >14 | 265-320 |

In a production and manufacturing process, to ensure good quality of a wheel, content of harmful gas and content of harmful residual elements in steel need to be slow. When the wheel is in a high-temperature state, a rim tread is intensively cooled with a water spray, to improve strength and hardness of a rim. This is equivalent to that normalizing heat treatment is performed on a web and a wheel hub, so that the rim has high strength-roughness matching, and the web has high roughness, thereby finally realizing excellent comprehensive mechanical properties and service performance of the wheel.

In wheel steel having pearlite and a small amount of ferritic, the ferritic is a soft domain material, has good roughness and low yield strength. The ferritic is soft and therefore, has poor rolling contact fatigue (RCF) resistance performance. Generally, higher content of the ferritic leads to better impact toughness of the steel. Compared with the ferritic, the pearlite has higher strength and poorer roughness, and therefore has poorer impact performance. The rail traffic develops towards a high speed and a heavy load. During running, load borne by a wheel will be significantly increased. An existing wheel made of pearlite and a small amount of ferritic has more problems exposed in a running service process. Several main disadvantages are as follows:

(1) A rim has low yield strength, which generally does not exceed 600 MPa. During wheel running, because a rolling contact stress between a wheel and a rail is relatively large, which sometimes exceeds yield strength of wheel steel, plastic deformation is caused to the wheel during a running process, leading to plastic deformation of a tread subsurface. In addition, because brittle phases such as inclusions and cementite exist in steel, the rim is prone to micro-cracks. The micro-cracks cause detects such as peeling and rim cracking under the action of rolling contact fatigue during wheel running.

(2) High carbon content in the steel causes a poor thermal damage resistance capability. When tread braking is used or friction damage is caused during wheel slipping, temperature of a part of the wheel is increased to the austenitizing temperature of the steel. Then the steel is chilled to produce martensite. By such repeated thermal fatigue, thermal cracks on a brake are generated and detects such as flaking and spalling are caused.

(3) The wheel steel has poor hardenability. The rim of the wheel has a particular hardness gradient and hardness is uneven, which easily causes detects such as wheel flange wear and non-circularity.

With development and breakthrough of the research on a bainite phase change in steel, especially the research on theories and application of carbide-free bainite steel, good matching between high-strength and high-toughness can be realized. The carbide-free bainite steel has an ideal microstructure, and also has excellent mechanical properties. A fine microstructure of the carbide-free bainite steel is carbide-free bainite, namely, supersaturated lathy ferritic in nanometer scale, in the middle of which film-shaped carbon-rich residual austenite in nanometer scale exists, thereby improving the strength and toughness of the steel, especially the yield strength, impact toughness, and fracture toughness of the steel, and reducing notch sensitivity of the steel. Therefore, by using a bainite steel wheel, rolling contact fatigue (RCF) resistance performance of the wheel is effectively increased, phenomena of wheel peeling and flaking are reduced, and safety performance and service performance of the wheel are improved. Because the bainite steel wheel has low carbon content, thermal fatigue resistance performance of the wheel is improved, generation of thermal cracks on the rim is prevented, the number of times of repairing by turning and an amount of repairing by turning are reduced, the service efficiency of the rim metal is improved, and a service life of the wheel is prolonged.

Chinese Patent Publication No. CN1800427A published on Jul. 12, 2006 and entitled with "Bainite Steel For Railroad Carriage Wheel" discloses that chemical compositions (wt %) of steel are: carbon C: 0.08-0.45%, silicon Si: 0.60-2.10%, manganese Mn: 0.60-2.10%, molybdenum Mo: 0.08-0.60%, nickel Ni: 0.00-2.10%, chromium Cr: <0.25%, vanadium V: 0.00-0.20%, and copper Cu: 0.00-1.00%. A typical structure of the bainite steel is carbide-free bainite, which has excellent strength and toughness, low notch sensitivity, and good hot-crack resistance performance. The addition of the element Mo can increase hardenability of the steel. However, for a wheel having a large cross-section, there is a great difficulty in controlling production, and costs are relatively high.

British Steel Corporation Patent No. CN1059239C discloses bainite steel and a production process thereof. Chemical compositions (wt %) of the steel are: carbon C: 0.05-0.50%, silicon Si and/or aluminum Al: 1.00-3.00%, manganese Mn: 0.50-2.50%, and chromium Cr: 0.25-2.50%. A typical structure of the bainite steel is carbide-free bainite, which has high wearability and rolling contact fatigue resistance performance. Although the steel has good strength and toughness, a cross section of a steel rail is relatively simple, impact toughness performance at 20° C. is not high, and costs of the steel are high.

SUMMARY

An objective of the present invention is to provide a high strength, high toughness, heat-cracking resistant bainite steel wheel for rail transportation. Chemical components use a C—Si—Mn—Cu—Ni—B system, without particularly adding alloying elements such as Mo, V, and Cr, so that a typical structure of a rim is carbide-free bainite.

The present invention further provides a manufacturing method for the high strength, high toughness, heat-cracking resistant bainite steel wheel for rail transportation, so that the wheel obtains good comprehensive mechanical properties, and production is easy to control.

The high strength, high toughness, heat-cracking resistant bainite steel wheel for rail transportation provided in the present invention contains elements with the following weight percentages:

carbon C: 0.10-0.40%, silicon Si: 1.00-2.00%, manganese Mn: 1.00-2.50%, copper Cu: 0.20-1.00%, boron B: 0.0001-0.035%, nickel Ni: 0.10-1.00%, phosphorus P≤0.020%, and sulphur S≤0.020%, where the remaining is iron and unavoidable residual elements; and 1.50%≤Si+Ni≤3.00%, and 1.50%≤Mn+Ni+Cu≤3.00%.

When total content of Si and Ni is lower than 1.5%, a carbide is easily produced in the steel, which is adverse to obtaining a carbide-free bainite structure having good strength and toughness. In addition, the steel contains Cu, easily causing Cu induced thermal cracks. When total content of Si and Ni is higher than 3.0%, functions of the elements cannot be effectively played, and costs are increased.

Preferably, the high strength, high toughness, heat-cracking resistant bainite steel wheel for rail transportation contains elements with the following weight percentages:

carbon C: 0.15-0.25%, silicon Si: 1.40-1.80%, manganese Mn: 1.40-2.00%, copper Cu: 0.20-0.80%, boron B: 0.0003-0.005%, nickel Ni: 0.10-0.60%, phosphorus P≤0.020%, and sulphur S≤0.020%, where the remaining is iron and residual elements, 1.50%≤Si+Ni≤3.00%, and 1.50%≤Mn+Ni+Cu≤3.00%.

More preferably, the high strength, high toughness, heat-cracking resistant bainite steel wheel for rail transportation contains elements with the following weight percentages:

carbon C: 0.18%, silicon Si: 1.63%, manganese Mn: 1.95%, copper Cu: 0.21%, boron B: 0.001%, nickel Ni: 0.18%, phosphorus P: 0.012%, and sulphur S: 0.008%, where the remaining is iron and unavoidable residual elements.

A microstructure of the bainite steel wheel is: a metallographic structure within 40 millimeters below a rim tread is a carbide-free bainite structure, namely, supersaturated lathy ferritic in nanometer scale, where film-shaped carbon-rich residual austenite in nanometer scale exists in the middle of the supersaturated lathy ferritic in nanometer scale, and a volume percentage of the residual austenite is 4%-15%. A rim microstructure is a multiphase structure formed by supersaturated ferritic and carbon-rich residual austenite, and a size of the rim microstructure is in nanometer scale and ranges from 1 nanometer to 999 nanometers.

The wheel provided in the present invention may be used for production of freight car wheels and passenger car wheels, and other elements and similar elements in rail transportation.

The manufacturing method for the high strength, high toughness, heat-cracking resistant bainite steel wheel for rail transportation provided in the present invention includes smelting, refining, molding, and heat treatment processes. The smelting, refining, and molding processes use the prior art, and the heat treatment process is:

heating a molded wheel to austenite temperature, intensively cooling a rim tread with a water spray to a temperature below 400° C., and performing tempering treatment. The heating to austenite temperature is specifically: heating to 860-930° C. and maintaining at the temperature for 2.0-2.5 hours. The tempering treatment is: performing tempering at medium or low temperature for more than 30 minutes when the temperature of the wheel is less than 400° C., and air cooling the wheel to room temperature after the tempering; or intensively cooling the rim tread with the water spray to the temperature below 400° C., and air cooling to room temperature, during which self-tempering is performed by using waste heat of the web and the wheel hub.

The heat treatment process may alternatively be: Heating treatment of the wheel with high-temperature waste heat after the molding, and directly intensively cooling a rim tread of a molded wheel with a water spray to a temperature below 400° C., and performing tempering treatment. The tempering treatment is: performing tempering at medium or low temperature for more than 30 minutes when the temperature of the wheel is less than 400° C., and air cooling the wheel to room temperature after the tempering; or intensively cooling the rim tread with the water spray to the temperature below 400° C., and air cooling to room temperature, during which self-tempering is performed by using waste heat of the web and the wheel hub.

The heat treatment process may alternatively be: air cooling a wheel to a temperature below 400° C. after the wheel is molded, and performing tempering treatment. The tempering treatment is: performing tempering at medium or low temperature for more than 30 minutes when the temperature of the wheel is less than 400° C., and air cooling the wheel to room temperature after the tempering; or air cooling to a temperature below 400° C., and air cooling to room temperature, during which self-tempering is performed by using waste heat of the web and the wheel hub.

Specifically, the heat treatment process is any one of the following:

heating the wheel to the austenite temperature, intensively cooling the rim tread with the water spray to the temperature below 400° C., and air cooling to room temperature, during which self-tempering is performed by using waste heat of the web and the wheel hub; or heating the wheel to the austenite temperature, intensively cooling the rim tread with the water spray to the temperature below 400° C., performing tempering at medium or low temperature for more than 30 minutes when the temperature of the wheel is less than 400° C., and air cooling to room temperature after the tempering, where the heating to the austenite temperature is specifically: heating to 860-930° C. and maintaining at the temperature for 2.0-2.5 hours; or intensively cooling, by using high-temperature waste heat after the wheel is molded, the rim tread with the water spray to the temperature below 400° C., and air cooling to room temperature, during which self-tempering is performed by using waste heat of the web and the wheel hub; or intensively cooling, by using high-temperature waste heat after the wheel is molded, the rim tread with the water spray to the temperature below 400° C., performing tempering at medium or low temperature for more than 30 minutes when the temperature of the wheel is less than 400° C., and air cooling to room temperature after the tempering; or after the wheel is molded, air cooling the wheel to the temperature below 400° C., and then performing self-tempering by using the waste heat after the molding; or after the wheel is molded, air cooling the wheel to the temperature below 400° C., performing tempering at medium or low temperature for more than 30 minutes when the temperature of the wheel is less than 400° C., and air cooling to room temperature after the tempering.

Functions of the elements in the present invention are as follows:

C content: is a basic element in the steel and has strong functions of interstitial solution hardening and precipitation strengthening. As the carbon content increases, strength of the steel is improved and toughness of the steel is reduced. A solubility of carbon in austenite is far greater than that in ferritic, and carbon is a valid austenite-stabilizing element. A volume fraction of carbide in the steel is in direct proportion to the carbon content. To obtain a carbide-free bainite structure, it needs to be ensured that particular C content dissolves in supercooled austenite and supersaturated ferritic, thereby effectively improving strength and hardness of the material, especially yield strength of the material. When the C content is higher than 0.40%, cementite is precipitated, reducing roughness of the steel. When the C content is lower than 0.10%, supersaturation of ferritic is reduced, and the strength of the steel is reduced. Therefore, a proper range of the carbon content is preferably 0.10-0.40%.

Si content: is a basic alloying element in the steel, and is a common deoxidizer. An atomic radius of Si is less than an atomic radius of iron, and Si has a strong solution strengthening function on austenite and ferritic. In this way, shear strength of the austenite is improved. Si is a noncarbide former, which prevents precipitation of cementite, facilitates formation of a bainite-ferritic carbon-rich austenite film and (M-A) island-type structure, and is a main element for obtaining the carbide-free bainite steel. Si can further prevent precipitation of cementite, thereby preventing precipitation of carbide due to decomposition of supercooled austenite. When tempering is performed at 300 C-400° C., precipitation of cementite is completely suppressed, thereby improving thermal stability and mechanical stability of the austenite. When the Si content in the steel is higher than 2.00%, a tendency of precipitating proeutectoid ferritic is increased, and strength and toughness of the steel are reduced. When the Si content is lower than 1.00%, cementite is easily precipitated from the steel, and a carbide-free bainite structure is not easily obtained. Therefore, the Si content should be controlled from 1.00-2.00%.

Mn content: Mn has functions such as improving stability of austenite in the steel and improving hardenability of the steel, to obviously improve hardenability of bainite and strength of bainite steel. Mn can improve a diffusion coefficient of phosphorus, facilitate segregation of phosphorus towards a grain boundary, and improve brittleness and tempering brittleness of the steel. When the Mn content is lower than 1.00%, the hardenability of the steel is poor, which is adverse to obtaining carbide-free bainite. When the Mn content is higher than 2.50%, the hardenability of the steel is significantly improved. In addition, a diffusion tendency of P is also greatly improved, and toughness of the steel is reduced. Therefore, the Mn content should be controlled from 1.00-2.50%.

Cu content: Copper is also a noncarbide former, and can facilitate formation of austenite. Solubility of copper in the steel changes greatly. Copper has functions of solution strengthening and dispersion strengthening, and can improve yield strength and tensile strength. In addition, copper can improve corrosion resistance of the steel. Because copper has a low melting point, during rolling and heating, a surface of a steel billet is oxidized, and is liquefied at a low melting point along a grain boundary. Therefore, a steel surface is prone to cracking. This harmful effect can be avoided through correct alloying and preparation process optimization. When the Cu content is lower than 0.20%, the corrosion resistance of the steel is poor. When the Cu content is higher than 1.00%, the steel surface is prone to cracking. Therefore, the Cu content should be controlled from 0.20-1.00%.

B content: B improves hardenability of the steel. The reason is that in an austenitization process, ferritic is most easily nucleated along a grain boundary. Because B is absorbed along the grain boundary to fill defects and reduce grain boundary energy, a new phase is difficult to nucleate, and stability of austenite is improved, thereby improving the hardenability. However, different segregation states of B lead to different impact of B. After the defects along the grain boundary are filled, if there still are more B in nonequilibrium segregation, a deposit of "B phase" is formed along the grain boundary, increasing grain boundary energy. In addition, the "B phase" is used as a core of a new phase, facilitating an increase in a nucleation rate, and leading to a decrease in the hardenability. That is, obvious "B phase" precipitation has a bad effect on the hardenability. In addition, a large amount of precipitated "B phase" causes the steel to become brittle, leading to poor mechanical properties. When the B content in the steel is higher than 0.035%, excessive "B phase" is generated, and the hardenability is reduced. When the B content is lower than 0.0001%, a function of reducing the grain boundary energy is limited, leading to insufficient hardenability. Therefore, the B content should be controlled from 0.0001-0.035%.

Ni content: Ni is a noncarbide former, and can inhibit precipitation of carbide in a bainite conversion process. In this way, a stable austenite film is formed between bainite ferritic laths, facilitating formation of a carbide-free bainite structure. Ni can improve strength and toughness of the steel, is an inevitable alloying element for obtaining high impact toughness, and lowers impact toughness conversion temperature. Ni and Cu may form an infinitude solid solution, to improve a melting point of Cu and reduce a harmful effect of Cu. When the Ni content is lower than 0.10%, it is adverse to forming carbide-free bainite, and reducing the harmful effect such as cracking caused by Cu. When the Ni content is higher than 1.00%, contribution rates of the strength and toughness of the steel are greatly reduced, and production costs are increased. Therefore, the Ni content should be controlled from 0.10-1.00%.

P content: P is prone to grain boundary segregation in medium and high carbon steel, to weaken a grain boundary and reduce strength and toughness of the steel. As a harmful element, when P≤0.020%, the performance is not greatly adversely affected.

S content: S is prone to grain boundary segregation, and easily forms an inclusion together with other elements, to reduce strength and toughness of the steel. As a harmful element, when SA≤0.020%, the performance is not greatly adversely affected.

According to the present invention, the chemical components of the steel are designed to be a C—Si—Mn—Cu—Ni—B system, without particularly adding the alloying elements such as Mo, V, and Cr, and by using advanced preparation and heat treatment processes and technologies, the typical structure of the rim is carbide-free bainite, namely, the supersaturated lathy ferritic in nanometer scale, in the middle of which the film-shaped carbon-rich residual austenite in nanometer scale exists, where the residual austenite is 4%-15%. The wheel has characteristics such as excellent strength and toughness and low notch sensitivity. Not particularly adding the alloying elements such as Mo, V, and Cr, and adding a small amount of B to replace some Mo can enable the steel to obtain more proper hardenability. Therefore, production is relatively easy to control, and costs are relatively low. Using the advanced heat treatment process can enable the steel to obtain good comprehensive mechanical properties. Costs of the steel are greatly reduced without particularly adding the alloying elements such as Mo, V, and Cr. Using the advanced heat treatment process can enable the steel to obtain good comprehensive mechanical properties, and production is easy to control. In addition, addition of Ni enables the steel to have higher impact toughness performance at 20° C.

According to the present invention, the noncarbide formers such as Si, Ni, and Cu are mainly used to improve activity of carbon in ferritic, defer and inhibit precipitation of carbide, and implement multielement composite strengthening, so that the carbide-free bainite structure is easily realized. The Mn element has a good austenite stabilization function, to improve the hardenability and the strength of the steel. According to the design of the heat treatment process, the rim tread is intensively cooled with the water spray, so that the rim of the wheel obtains the carbide-free bainite structure. Alternatively, self-tempering using the waste heat or tempering at medium or low temperature is performed on a composite structure based on the carbide-free bainite structure, to further improve structure stability of the wheel and the comprehensive mechanical properties of the wheel. In addition, characteristics such as good solution strengthening and precipitation strengthening of the element Cu are used to further improve the strength and the toughness without lowering a toughness indicator. Moreover, corrosion resistance performance of the elements Ni and Cu is used to realize atmospheric corrosion resistance of the wheel, thereby improving a service life of the wheel.

According to the foregoing design of the alloying components and the preparation process, the rim of the wheel obtains the carbide-free bainite structure, and the web and the wheel hub obtain the metallographic structure based on granular bainite and the supersaturated ferritic structure.

Compared with the CL60 wheel in the prior art, for the bainite steel wheel prepared in the present invention, matching between the strength and the toughness of the rim is obviously improved, so as to effectively improve, while ensuring safety, the yield strength, the toughness, and the low-temperature toughness of the wheel, the rolling contact fatigue (RCF) resistance performance of the wheel, the heat-cracking resistant performance of the wheel, and the corrosion resistance performance of the wheel, reduce the notch sensitivity of the wheel, reduce a probability of peeling or flaking of the wheel in use, implement even wear and less repairing by turning of the tread of the wheel, improve the service efficiency of the rim metal of the wheel, and improve the service life and comprehensive efficiency of the wheel, bringing specific economic and social benefits.

DETAILED DESCRIPTION OF THE PREFERRED EMBODIMENTS

Weight percentages of chemical components of wheel steel in Embodiments 1, 2, and 3 are shown in Table 2. In Embodiments 1, 2, and 3, a (1:0380 mm round billet directly cast after EAF smelting, and LF+RH refining and vacuum degassing is used. Then, the round billet forms a freight car wheel having a diameter of 840 mm, a passenger car wheel having a diameter of 915 mm, or the like after ingot cutting, heating and rolling, heat treatment, and finishing.

Embodiment 1

A high strength, high toughness, heat-cracking resistant bainite steel wheel for rail transportation contains elements with the following weight percentages shown in Table 2.

A manufacturing method for the high strength, high toughness, heat-cracking resistant bainite steel wheel for rail transportation includes the following steps:

forming the wheel by using liquid steel in Embodiment 1 with chemical components shown in Table 2 through an EAF steelmaking process, an LF refining process, an RH vacuum treatment process, a round billet continuous casting process, an ingot cutting and rolling process, a heat treatment process, processing, and a finished product detection process. The heat treatment process is: heating to 860-930° C. and maintaining at the temperature for 2.0-2.5 hours; controlling and cooling a rim tread with a water spray, performing tempering treatment at 220° C. for 4.5-5.0 hours, and cooling to room temperature.

Figure 1:
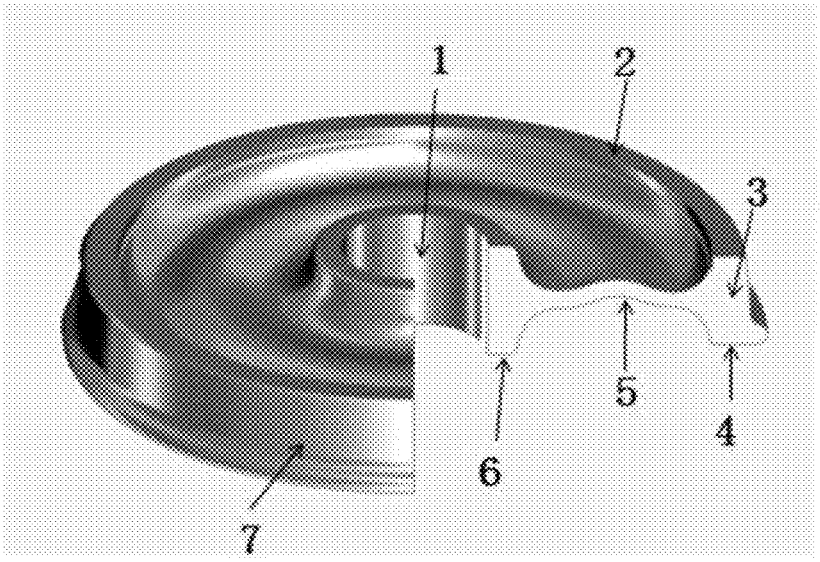
FIG. 1 is a schematic diagram of names of parts of a wheel, where 1: wheel hub hole; 2: outer side face of a rim; 3: rim; 4: inner side face of the rim; 5: web; 6: wheel hub; and 7: tread.
Figure 2:
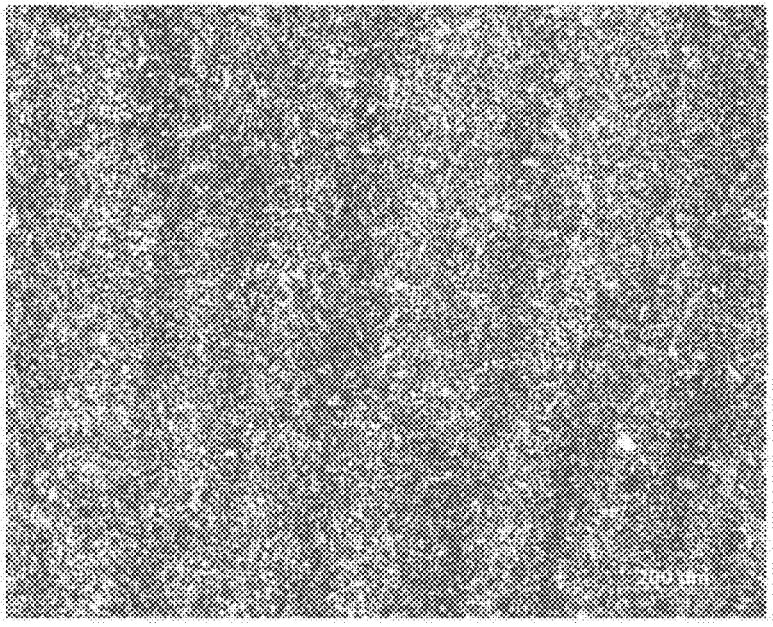
FIG. 2*a* is a diagram of a 100× optical metallographic structure of a rim according to Embodiment 1.
FIG. 2*b* is a diagram of a 500× optical metallographic structure of a rim according to Embodiment 1.
Figure 2:
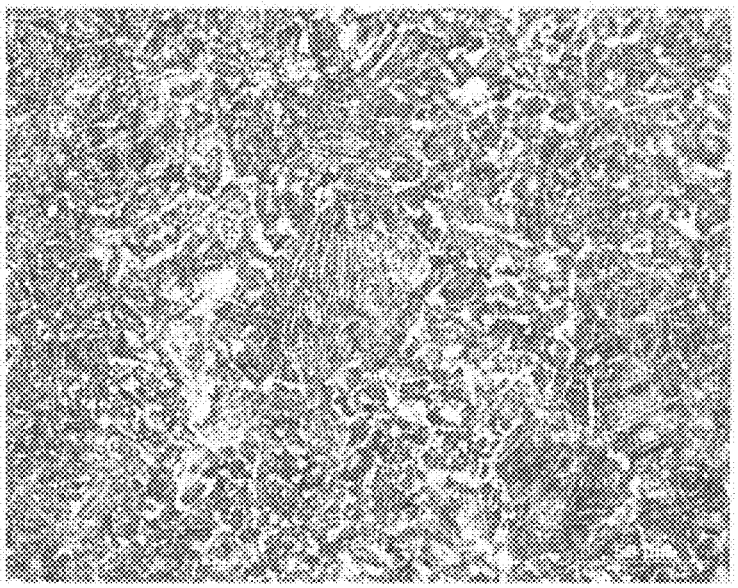
Figure 3:
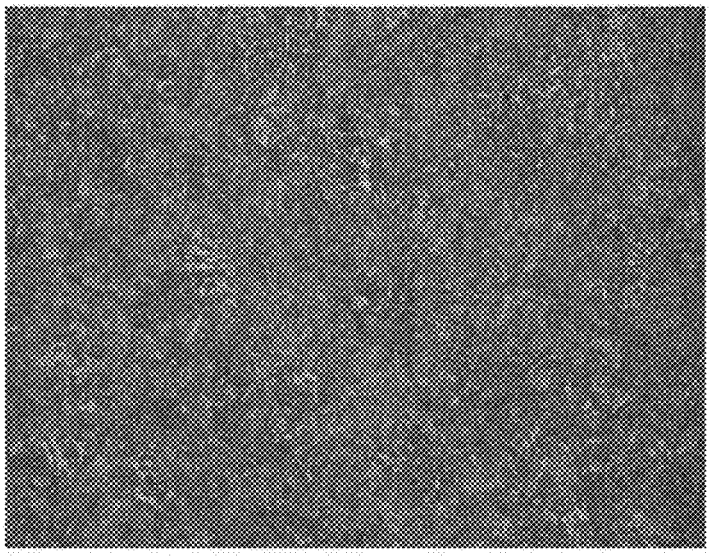
FIG. 3*a* is a diagram of a 100× optical metallographic structure of a rim according to Embodiment 2.
FIG. 3*b* is a diagram of a 500× optical metallographic structure of a rim according to Embodiment 2.
FIG. 3*c* is a diagram of a 500× dyed metallographic structure of a rim according to Embodiment 2.
FIG. 3*d* is a diagram of a transmission electron microscope structure of a rim according to Embodiment 2.
Figure 3:
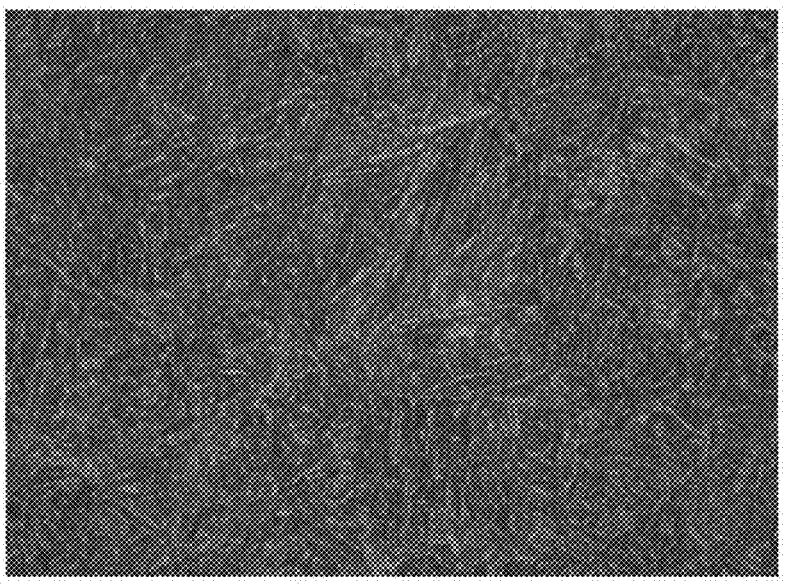
Figure 3:
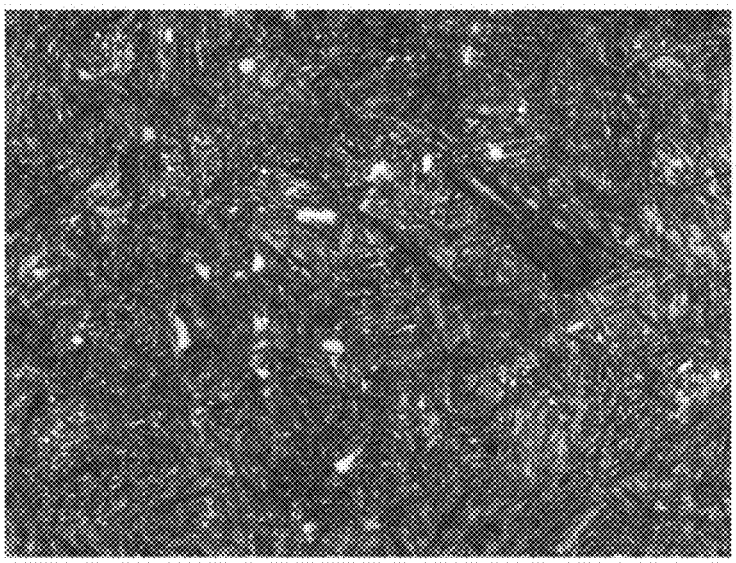
Figure 3:
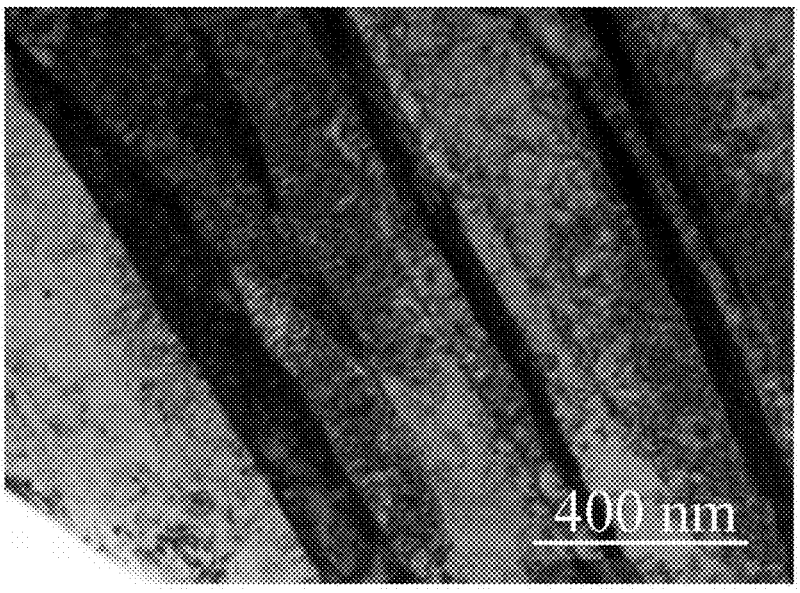
Figure 4:
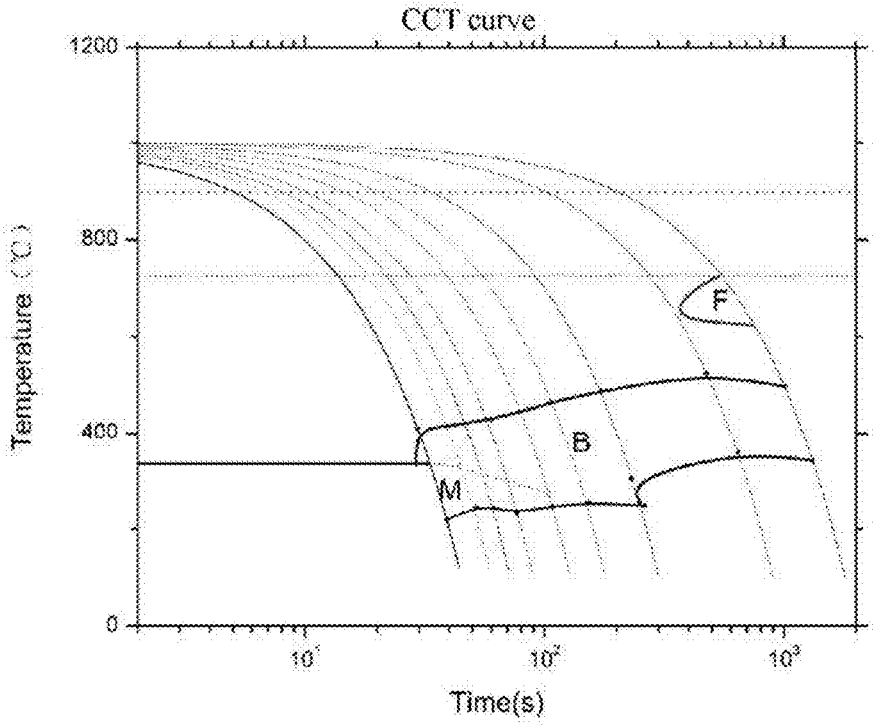
FIG. 4 is a continuous cooling transformation curve (CCT curve) of steel according to Embodiment 2.

As shown in FIG. 2*a* and FIG. 2*b*, a metallographic structure of a rim of the wheel prepared in this embodiment is a carbide-free bainite structure. Mechanical properties of the wheel in this embodiment are shown in Table 3, and matching between strength and toughness of the wheel is superior to that of a CL60 wheel.

Embodiment 2

A high strength, high toughness, heat-cracking resistant bainite steel wheel for rail transportation contains elements with the following weight percentages shown in Table 2.

A manufacturing method for the high strength, high toughness, heat-cracking resistant bainite steel wheel for rail transportation includes the following steps:

forming the wheel by using liquid steel in Embodiment 2 with chemical components shown in Table 2 through a steelmaking process, a refining process, a vacuum degassing process, a round billet continuous casting process, an ingot cutting process, a forging and rolling process, a heat treatment process, processing, and a finished product detection process. The heat treatment process is: heating to 860-930° C. and maintaining at the temperature for 2.0-2.5 hours; controlling and cooling a rim tread with a water spray, performing tempering treatment at 280° C. for 4.5-5.0 hours, and cooling to room temperature.

As shown in FIG. 3*a*, FIG. 3*b*, FIG. 3*c*, and FIG. 3*d*, a metallographic structure of a rim of the wheel prepared in this embodiment is mainly carbide-free bainite. Mechanical properties of the wheel in this embodiment are shown in Table 3, and matching between strength and toughness of the wheel is superior to that of a CL60 wheel.

Embodiment 3

A wheel was formed by using liquid steel in Embodiment 3 with chemical components shown in Table 2 through a steelmaking process, a refining process, a vacuum degassing process, a round billet continuous casting process, an ingot cutting process, a forging and rolling process, a heat treatment process, processing, and a finished product detection process. The heat treatment process is: heating to 860-930° C. and maintaining at the temperature for 2.0-2.5 hours; controlling and cooling a rim tread with a water spray, and performing tempering treatment at 320° C. for 4.5-5.0 hours.

Figure 5:
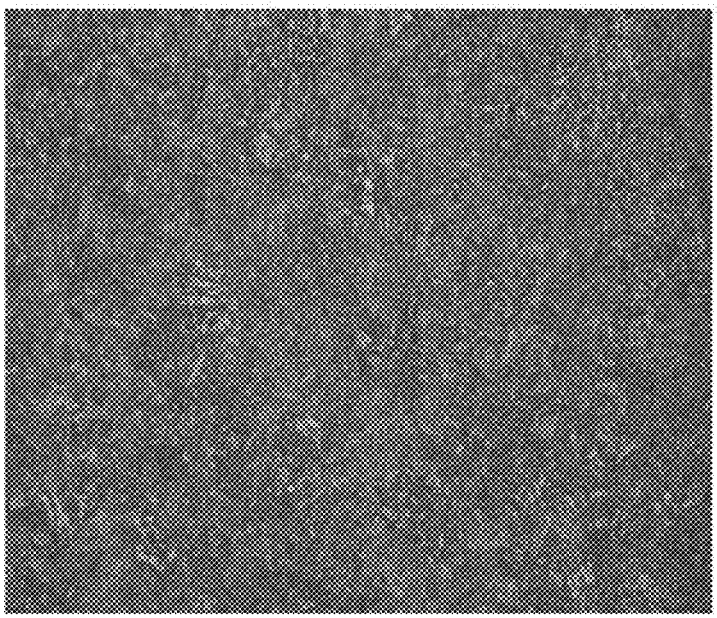
FIG. 5*a* is a diagram of a 100× optical metallographic structure of a rim according to Embodiment 3.
FIG. 5*b* is a diagram of a 500× optical metallographic structure of a rim according to Embodiment 3.
Figure 5:
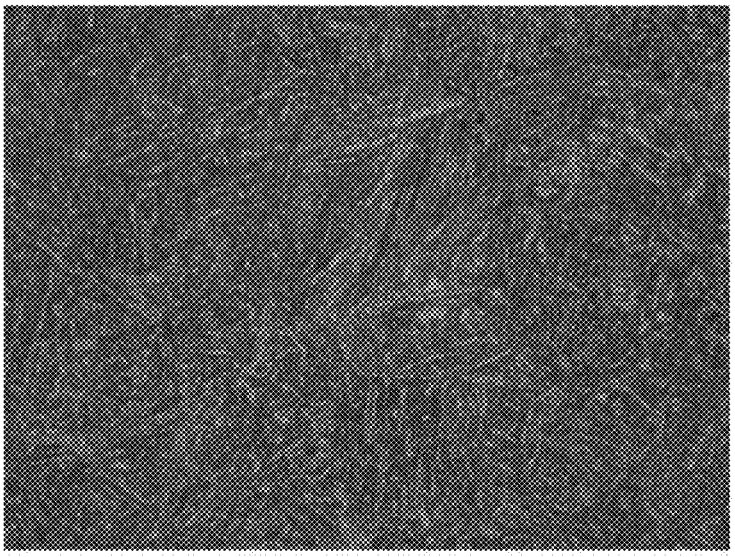
Figure 6:
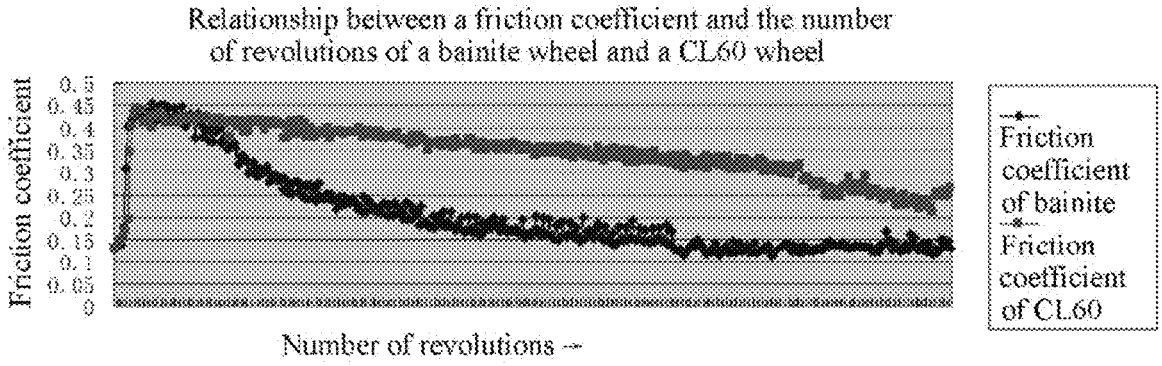
FIG. 6 shows a relationship comparison between a friction coefficient and the number of revolutions in a friction and wear test of a wheel according to Embodiment 2 and a CL60 wheel.
Figure 7:
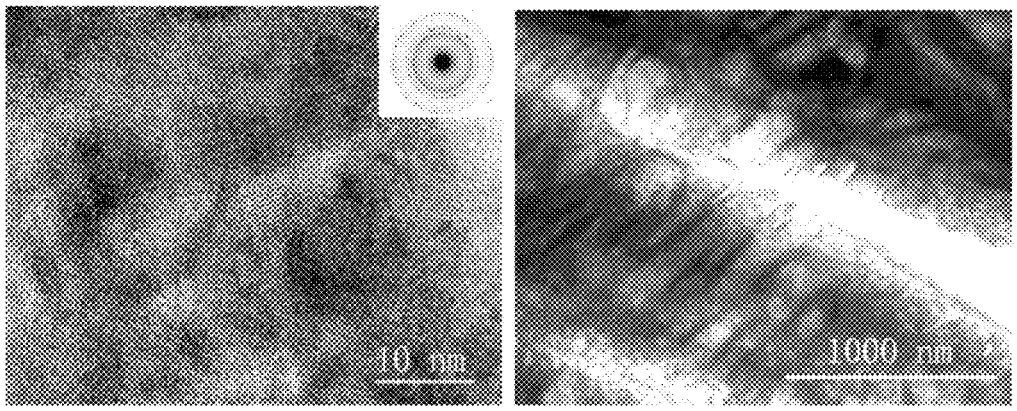
FIG. 7 shows structures of deformation layers on surfaces of samples of a wheel according to Embodiment 2 and a CL60 wheel after a friction and wear test.

As shown in FIG. 5*a* and FIG. 5*b*, a metallographic structure of a rim of the wheel prepared in this embodiment is mainly carbide-free bainite. Mechanical properties of the wheel in this embodiment are shown in Table 3, and matching between strength and toughness of the wheel is superior to that of a CL60 wheel.

TABLE 2

Chemical components (wt %) of wheels in Embodiments 1, 2, and 3 and comparison examples.

| Embodiment and example | C | Si | Mn | Cu | B | Ni | P | S |
|---|---|---|---|---|---|---|---|---|
| Embodiment 1 | 0.25 | 1.50 | 1.29 | 0.35 | 0.020 | 0.29 | 0.009 | 0.007 |
| Embodiment 2 | 0.18 | 1.63 | 1.95 | 0.21 | 0.001 | 0.18 | 0.012 | 0.008 |
| Embodiment 3 | 0.31 | 1.28 | 1.56 | 0.32 | 0.010 | 0.53 | 0.015 | 0.011 |
| CL60 wheel | 0.63 | 0.24 | 0.71 | / | / | / | 0.010 | 0.001 |
| Chinese Patent CN100395366C | 0.2 | 1.5 | 1.8 | 0.1 | / | 0.2 | / | / |
| UK Patent CN1059239C | 0.22 | 0.5-3.0 | 0.5-2.5 | / | / | / | / | / |

TABLE 3

Mechanical properties of rims of wheels in Embodiments 1, 2, and 3 and comparison examples

| Embodiment and example | $Rp_{0.2}$ MPa | Rm MPa | A % | Z % | Cross-section hardness HB | Room temperature KU J | $K_Q$ MPa · $m^{1/2}$ |
|---|---|---|---|---|---|---|---|
| Embodiment 1 | 612 | 1003 | 17 | 39 | 309 | 83 | 90.6 |
| Embodiment 2 | 668 | 1060 | 16 | 39 | 315 | 78 | 83.1 |
| Embodiment 3 | 717 | 1159 | 15 | 38 | 339 | 61 | 70.2 |
| CL60 wheel | 630 | 994 | 15.5 | 39 | 290 | 25 | 56.3 |
| Chinese Patent CN100395366C | 779 | 1198 | 16 | 40 | 360 | 52 | / |
| UK Patent CN1059239C | 730 | 1250 | 17 | 55 | 400 | 39 | 60(−20° C.) |

What is claimed is:

1. A bainite steel wheel for rail transportation, comprising:

carbon C: 0.15-0.25%;

silicon Si: 1.40-1.80;

manganese Mn: 1.40-2.00%;

copper Cu: 0.20-0.80%;

boron B: 0.0003-0.005%;

nickel Ni: 0.10-0.60%;

phosphorus P≤0.020%; and sulphur S≤0.020%;

wherein the remaining is iron and unavoidable residual elements;

wherein 1.50%≤Si+Ni≤3.00%, and 1.50%≤Mn+Ni+Cu≤3.00%;

wherein the portion of the bainite steel wheel that is between the surface of a rim tread and 40 millimeters below the rim tread is organized into a microstructure of a carbide-free bainite structure, wherein the carbide-free bainite structure comprises a supersaturated lath ferrite in nanometer scale, wherein a film-shaped carbon-rich residual austenite in nanometer scale is interspersed among the supersaturated lath ferrite, and wherein a volume percentage of the residual austenite is 4%-15%; and wherein the microstructure of the bainite steel wheel was formed by the steps of smelting, refining, molding, and heat treatment processes, wherein the heat treatment process comprises heating a molded wheel to austenite temperature by heating to 860-930° C. and maintaining at the temperature for 2.0-2.5 hours, intensively cooling a rim tread with a water spray to a temperature below 400° C., and performing tempering treatment.

2. The bainite steel wheel for rail transportation according to claim 1, comprising:

carbon C: 0.18%;

silicon Si: 1.63%;

manganese Mn: 1.95%;

copper Cu: 0.21%;

boron B: 0.001%;

nickel Ni: 0.18%;

phosphorus P: 0.012%; and sulphur S: 0.008%.

3. The bainite steel wheel for rail transportation according to claim 1, wherein the microstructure is a multiphase structure formed by the supersaturated lath ferrite and the carbon-rich residual austenite, and a size of the nanometer scale ranges from 1-999 nm.

4. The bainite steel wheel for rail transportation according to claim 1, wherein a tempering treatment is as follows: performing tempering at medium or low temperature for more than 30 minutes when the temperature of the wheel is less than 400° C., and air cooling the wheel to room temperature after the tempering; or intensively cooling the rim tread with the water spray to the temperature below 400° C., and air cooling to room temperature, during which self-tempering is performed by using waste heat.

5. The bainite steel wheel for rail transportation according to claim 1, wherein the heat treatment process comprises: heating treatment of the wheel with high-temperature waste heat after the molding, and directly intensively cooling a rim tread of a molded wheel with a water spray to a temperature below 400° C., and performing tempering treatment.

* * * * *